US007252739B2

(12) United States Patent
Brottgardh et al.

(10) Patent No.: US 7,252,739 B2
(45) Date of Patent: Aug. 7, 2007

(54) METHOD FOR DISTRIBUTING CELLULOSE PULP OF LOW AND MEDIUM CONSISTENCY IN ORDER TO FORM A UNIFORM PULP WEB

(75) Inventors: Goran Brottgardh, Karlstad (SE); Axel Lamas, Karlstad (SE); Bo Clarstrom, Kil (SE)

(73) Assignee: GL&V Management Hungary Kft., Glacis (LU)

( * ) Notice: Subject to any disclaimer, the term of this patent is extended or adjusted under 35 U.S.C. 154(b) by 143 days.

(21) Appl. No.: 10/992,148

(22) Filed: Nov. 18, 2004

(65) Prior Publication Data

US 2005/0126725 A1 Jun. 16, 2005

Related U.S. Application Data

(62) Division of application No. 09/991,625, filed on Nov. 6, 2001, now abandoned.

(30) Foreign Application Priority Data

Jan. 26, 2001 (SE) ..... 0100259

(51) Int. Cl.
*D21C 3/26* (2006.01)

(52) U.S. Cl. ..... 162/18; 162/19; 162/24; 162/60; 162/301; 100/110; 100/118; 100/120; 210/401; 210/400; 210/402

(58) Field of Classification Search ..... 162/18, 162/301, 300, 323, 60, 19, 24; 100/110, 100/118, 120; 210/401, 400, 402
See application file for complete search history.

(56) References Cited

U.S. PATENT DOCUMENTS 3,051,233 A * 8/1962 Baxter, Jr. ..... 162/337
3,943,033 A * 3/1976 Wallen ..... 162/232
4,214,947 A * 7/1980 Berger ..... 162/18
4,559,104 A * 12/1985 Eriksson ..... 162/336

* cited by examiner

*Primary Examiner*—Mark Halpern

(57) ABSTRACT

The method is for distributing cellulose pulp that has a 2-12% consistency. A manifoid housing is in fluid communication with distributor housing. The distributor housing has holes that are distributed along a generatrix of the distribution housing. The cellulose pulp is fed into an inlet of the manifold housing. The feed screw is rotated to convey the cellulose pulp in the transverse direction through the distributor housing. The feed screw sweeps across the holes in the distributor housing to urge the cellulose pulp through the holes. The cellulose pulp is uniformly fed through the holes and then through an inlet to dewatering drums. The cellulose pulp is run between the dewatering drums and a trough to form a pulp web. The pulp web is dewatered in a press nip formed between the dewatering drums. The dewatered pulp web is collected by a feed screw.

9 Claims, 3 Drawing Sheets

METHOD FOR DISTRIBUTING CELLULOSE PULP OF LOW AND MEDIUM CONSISTENCY IN ORDER TO FORM A UNIFORM PULP WEB

PRIOR APPLICATION

This application is a divisional patent application of U.S. national phase application Ser. No. 09/991,625 filed Nov. 6, 2001 now abandoned that claims priority from Swedish Patent Application No. 0100259-1, filed 26 Jan. 2001.

TECHNICAL FIELD

The invention relates to a distributor device.

PRIOR ART

A number of distributor devices for low and medium consistency pulp are known, these distributor devices being intended to form a uniform pulp web.

Most distributor devices for cellulose pulp use very simple solutions which do not guarantee an even distribution of the pulp across the entire width of the web. Wash presses in most cases simply use pulp troughs, of the types disclosed in U.S. Pat. No. 5,667,642, SE-A-9303382-7, SE-C-503010 and SE-C-501710 where the trough runs across the entire width of the web which is to be formed. Here, the drum on which the web is formed is allowed to entrain the pulp, which is in most cases done in a non-uniform manner and without positively acting distributor members in the distributor device. If wash liquid is additionally added from a gap which extends across the entire pulp web, this has the result that the wash effect is uncontrolled. The non-uniform pulp web formed then has non-uniform packing across its width, and as the water is introduced into a gap the water tends to pass through the pulp bed where it has the lowest degree of packing.

SE-A-9102370 discloses another device with a rotating cross-slit rotor arranged in the inlet. Here, the cross-slit rotor does not afford any positive distribution effects.

U.S. Pat. No. 4,085,003 discloses a variant with a uniform throttle valve along the entire distributor device. This valve cannot guarantee an even distribution across the width of the entire web.

SE-C-448009 discloses a distributor device in which the pulp is conveyed into an inlet at the end of a cylindrical distributor housing. A feed screw with continuously increasing core diameter, as seen from the inlet, then feeds the pulp out through a gap which extends across the entire web which is to be formed. This solution functions very well with an outlet gap which is arranged in the upper half of the distributor housing, i.e. within positions of the outlet gap between 8 o'clock and 4 o'clock on the distributor housing. The feed screw, which has a continuously increasing core diameter as seen from the inlet, contributes to the pulp maintaining uniform pressure towards the outlet slit, after which the pulp is tapped off from the outlet slit, at the same time as the feed screw keeps the outlet free.

SE-C-500546 discloses another solution in which the pulp is fed into the middle of a distribution box and is then forced to flow across the upper edge of an upwardly convex crescent-shaped distribution plate. The shape of the plate is intended to prevent most pulp being distributed on the web at the inlet, where the pressure is at its greatest. However, in practical application, it has been found that the pulp tends to be poorly distributed at the web edges. In addition, the same crescent shape does not give the same effect at different consistencies, since lower consistencies mean that the pulp flows more easily out to the edges of the crescent and does not build up the same height at the inlet.

The abovementioned solutions are an indication of the large number of proposals which have been considered and have been applied in practice in distributor devices for cellulose pulp from a low consistency of 2 to 5% and up to a medium consistency in the range of about 12 to 14%. Most of these solutions have not taken fully into consideration the importance of ensuring optimum uniform distribution of the pulp across the whole width of the pulp web. Only SE-C-448009 discloses a solution where a forced physical distribution of the pulp is obtained. As soon as a lower degree of packing of the pulp occurs in the pulp web, this has the effect that the flow of wash liquid for treating the pulp web is concentrated in these areas where there is a low degree of packing, which results in non-uniform treatment and an uneven quality of the treated pulp.

BRIEF DESCRIPTION OF THE INVENTION

The object of the invention is to obtain an optimum uniformly formed pulp web when feeding cellulose pulp in the consistency range of 2 to 14%. A bed which is packed uniformly across the entire width of the pulp web means that subsequent treatment, preferably washing/displacement wash, of the pulp web takes place uniformly, so that an even quality of pulp is obtained.

This object is achieved with the features of the present invention.

Another object is to obtain a distributor device with a high level of operability, i.e. minimal operational faults, and which is easy to start up with less need or no need for cleaning, dilution, or emptying of the distributor device. The invention has its main application in wash presses for cellulose pulp of the type which is disclosed in SE-C-512753, where the distributor device is arranged at the very top of a dewatering drum, and where the outlet forming the pulp web from the distributor device is directed downwards from the distributor device. The concept illustrated in SE-C-512753 initially utilizes gravitational forces for maximum dewatering effect when the pulp is softest (lowest concentration), at the same time as the available wash zone extends optimally across the greatest possible extent of the drum, typically over 270 degrees.

The invention ensures that the pulp at a consistency of 2 to 12% does not flow out in an uncontrolled manner to the pulp web around the pulp inlet from the distributor device, at which inlet the pressure is at its highest. This effect is most marked in the preferred embodiment where the outlet holes are arranged in the lower part of the jacket surface of the distributor housing. The interaction with the feed screw which, in a preferred embodiment, has its thread crests sweeping closely across the outlet holes, guarantees that the outlet holes are kept free without any risk of becoming clogged.

Further characteristics, aspects and advantages of the invention will become clear from the attached patent claims and from the following detailed description of a number of embodiments.

DETAILED DESCRIPTION OF THE INVENTION

Figure 1:
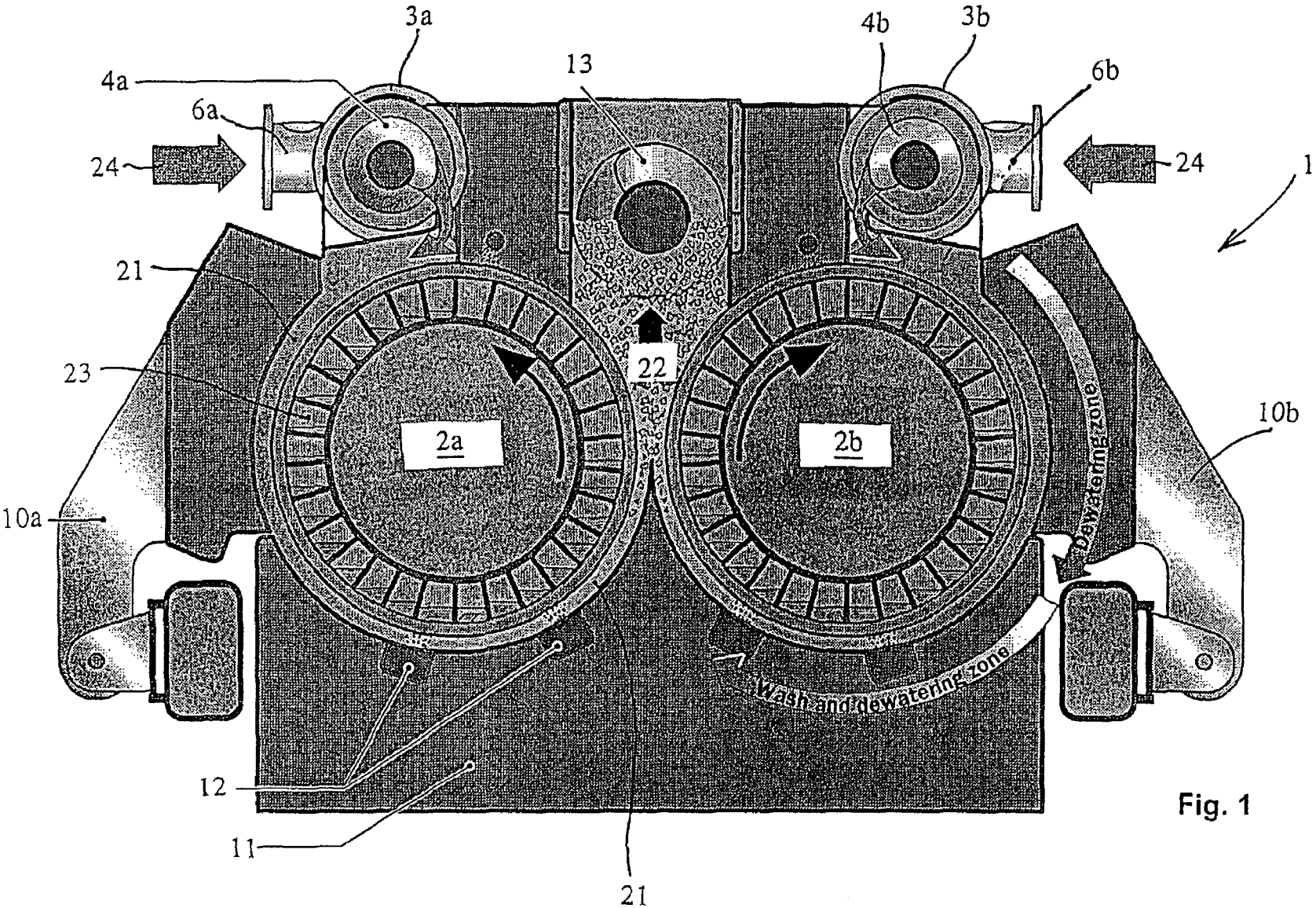
FIG. 1 shows a wash press in cross section, in which the distributor device (2 of them) according to the invention is used.

FIG. 1 shows a wash press 1 in which cellulose pulp of low consistency in the range of 2 to 12% is fed to the inlets 6*a*, 6*b* of the wash press.

Wash Press Construction—General

The wash press is of a type which is disclosed in SE-C-512753 in which the pulp is distributed via two inlets on respective dewatering drums 2*a*, 2*b*. By means of an initial distribution at the highest point of the drum, at 12 o'clock, an optimum initial dewatering is obtained by using gravitational forces, and at an initial stage when the cellulose pulp has its lowest consistency.

The pulp web 21 is distributed on each drum 2*a*, 2*b* and runs between drum and trough sweep over an angle range greater than 240 degrees, and at most 270 degrees, which gives the possibility of an extremely long treatment zone over each drum.

The pulp webs 21 finally meet in a press nip 22 formed between the drums where a last dewatering effect is obtained. Normally a consistency of 30% or more can be obtained after the press nip, and the washed and dewatered pulp is collected by a feed screw 13.

This innovative construction principle of the wash press permits excellent treatment of the pulp at a given drum size. The concept permits a high wash capacity for the small available surface in the pulp mill, for which reason it is well suited for upgrading existing plants.

The wash press forms the pulp web 21 between the perforated and dewatered outer surface of the drum 2*a*, 2*b* and the surrounding trough sweep, of which a first section consists of pivotable trough sweeps 10*a*, 10*b* and a final sweep section consists of a raisable and lowerable trough base 11. The first sections can have weakly converging trough sweeps with one or more wash liquid distributors 12 arranged transverse to the pulp web.

The Distributor Device According to the Invention

Each distributor housing 3*a*, 3*b* for each drum comprises a feed screw 4*a*, 4*b* arranged in the cylindrical distributor housing with its cylinder axis arranged horizontally and transverse to the pulp web 21.

Figure 2:
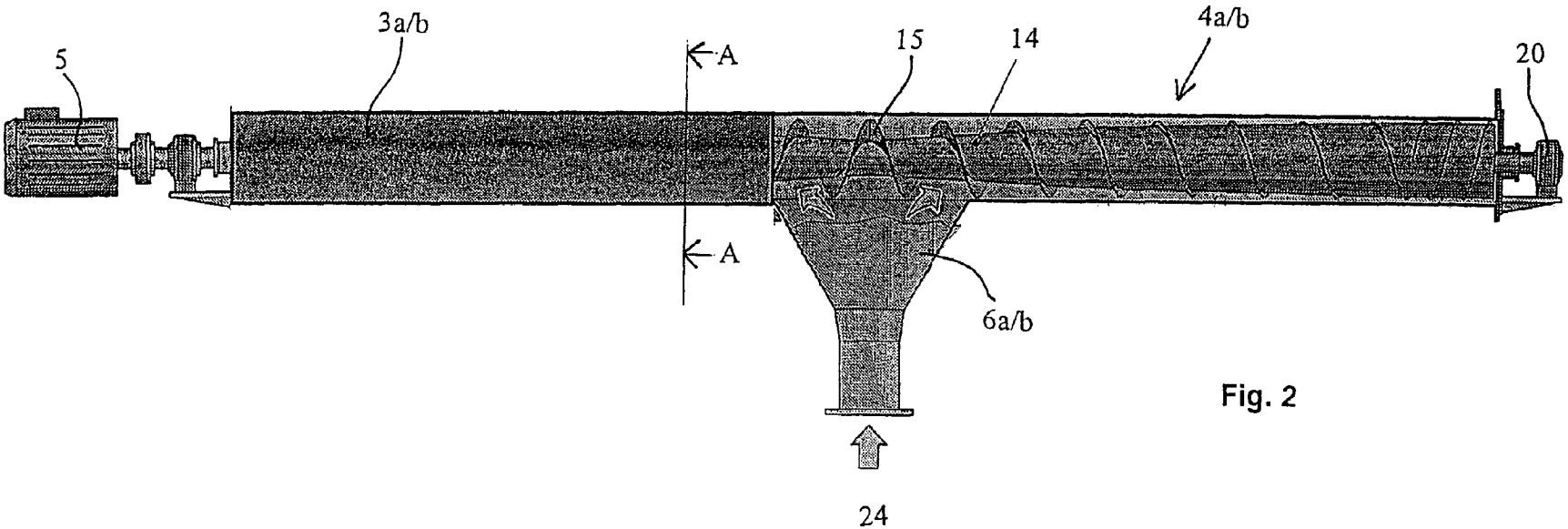
FIG. 2 shows the distributor device, viewed from above in FIG. 1, with the distributor housing partially cut away to illustrate the feed screw.

FIG. 2 shows one distributor housing seen from above in FIG. 1. The feed screw 4*a*, 4*b* is provided with a screw thread 15 with a substantially constant pitch, and a screw core 14 with a continuously increasing core diameter as seen from the inlet 6*a*, 6*b*, corresponding to that shown in SE-C-448009. The distributor housing can, as is shown in SE-C-448009, have an inlet at one end of the distributor housing, but in FIG. 2 the inlet is arranged at the middle of the distributor housing, and the screw thread 15 of the feed screw is mirror-inverted as seen from the centre of the inlet for conveying the pulp out towards the end walls of the distributor housing.

In this way it is possible to obtain a uniform pressing force on the pulp remaining in the distributor housing, where the remaining annular space for the pulp decreases continuously in the feed direction of the screw. A compensation is thus obtained for the pulp which is fed out nearest the pulp inlet 6*a*, 6*b*.

An alternative to a continuously increasing diameter of the screw core 14 can be a continuously decreasing pitch of the screw thread 15.

The screw is mounted 20 at each end and is driven by a motor 5, where the feed screw is arranged with its axis of rotation parallel to the cylinder axis of the distributor housing and is arranged to feed pulp from the inlet 6*a*, 6*b* and along the entire length of the distributor housing in the direction of its cylinder axis.

The figure also shows a shorter counter thread at the end of the distributor housing, where a counter pumping effect is obtained which is intended to counter the formation of plugs. This counter thread can be completely or partially omitted depending on the tendency of the pulp to form plugs and/or possible interaction with cleaning nozzles which are activated for a short time during stoppage or plugging tendencies. The counter thread can also be placed in an area of the housing outside the width of the web formed.

Figure 3:
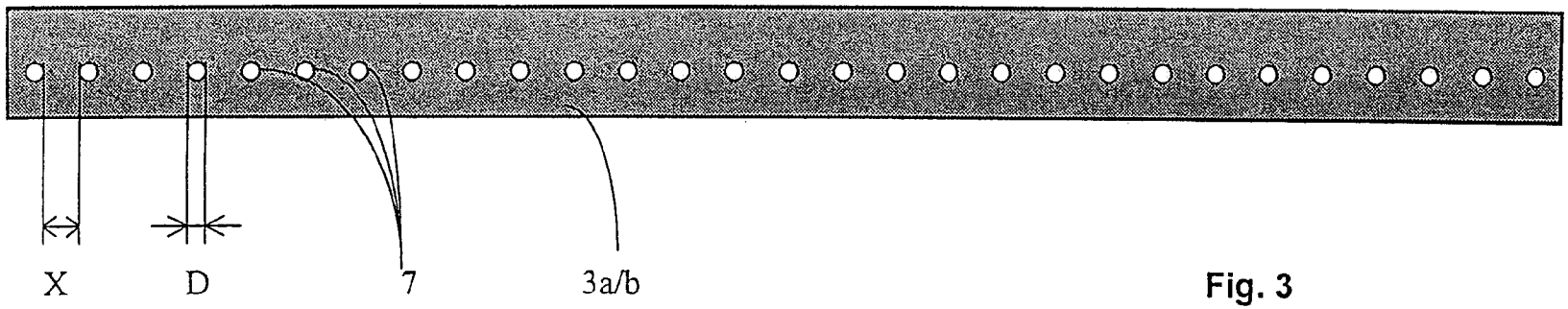
FIG. 3 shows the distributor housing, seen in a view opposite to FIG. 2, with its outlet holes.

FIG. 3 shows how the outlets from the distributor housing are arranged in the manner according to the invention. Instead of a gap extending across the entire housing, as is shown in SE-S-448009, the outlet consists of holes 7 arranged along the generatrix of the distributor housing, in the jacket surface of said distributor housing 3*a*, 3*b*, and with a defined hole diameter D, and where the holes are arranged at a distance X from each other.

The holes do not need to be so close when the pulp is relatively easy-flowing under the conditions which prevail under the action of the feed screw. The distance X between the holes expediently exceeds the hole diameter.

Tests have shown that a good distribution function is obtained with holes having a diameter of 40 mm, which holes are separated by a distance of 75 mm. The hole size and the spacing can vary, however, around these dimensions without unacceptably affecting the distribution function. The hole diameter can therefore vary within the range of 20 to 60 mm, and the distance between the holes can vary within the range of 40 to 90 mm, while the distance between the holes is at least 150% of the hole diameter.

In certain applications with pulp in the lower range of consistency, i.e. 2 to 5%, and/or in the case of a high initial feed pressure of the pulp, the holes can also be given a continuously increasing hole diameter as seen in the direction of feed of the feed screw 4*a*, 4*b* and from the inlet of the distributor housing. Such a design can give a certain throttle effect for the pulp which flows out in the holes 7 arranged nearest to the inlet 6*a*, 6*b*. In combination with an increasing core diameter of the feed screw (alternatively an increasing pitch of the thread), it is thus possible to obtain a uniform outflow across the entire width of the distributor housing.

As will be seen from FIG. 1, the outlets are arranged, for maximum initial dewatering effect, at the top of the wash press, with the outlets 7 arranged in the lower part of the distributor housing, directed substantially straight downwards from the distributor housing. The holes are intended to prevent pulp from falling freely down towards the pulp web, and the holes form a pressure drop which gives the pulp the possibility of being distributed across the entire distributor housing before being fed out from the housing. The holes are preferably arranged in the lowest part of the jacket surface of the distributor housing directed substantially straight down from the distributor housing around: a position corresponding to 6 o'clock, and within an area of rotation in the range of ±45 degrees from this position.

Figure 4:
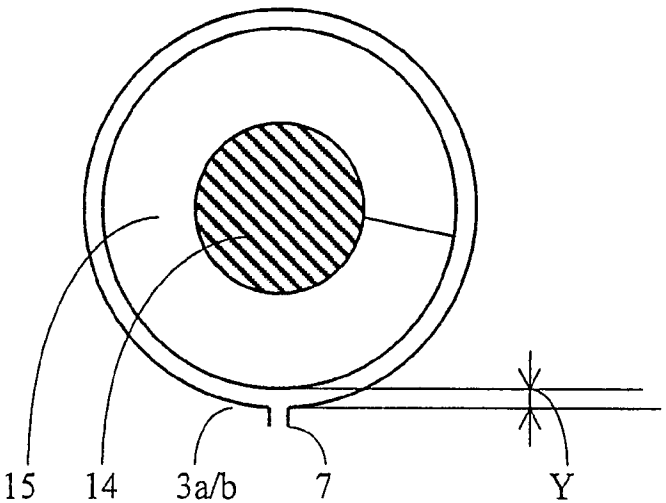
FIG. 4 shows an enlarged cross section A-A in FIG. 2 through the distributor housing.

FIG. 4 shows the interaction between the thread 15 of the feed screw 4*a*, 4*b* and the outlet holes 7 in the inner jacket surface of the distributor housing 3*a*, 3*b*. The thread 15 of the feed screw 4*a*, 4*b* sweeps with its crests across the holes. 7 at a predefined distance Y from the holes 7 in the inner jacket surface of the distributor housing. This interaction maintains continuous exposure of the holes. This is very advantageous when restarting after shutdown, as plug formations may have developed in and around the holes 7.

An extra nozzle section can also be located above the extra row of strainers 30 in the variant that is shown in FIG. 2.

The distance Y can be relatively large, up to 20 mm for consistencies in the upper range of 7 to 12%, without this exposure effect disappearing entirely. However, the distance Y can be optimized as a function of the actual consistency, where the optimum distance decreases as consistency increases.

The distance Y preferably lies in the range of 5 to 20 mm and is more preferably 10±2 mm.

The invention can be modified within the scope of the attached patent claims. For example, the holes can be arranged offset a slight distance either side of the generatrix of the jacket surface.

The outlet holes 7 from the distributor device can also be provided as tubular sleeve couplings nearest the distributor housing, with transition to an elliptic cross section at the outlets nearest the pulp web, and where the major axis of all elliptic cross sections is parallel.

The outlet holes nearest the distributor housing can also be slightly elliptic, the mean value of the minor axis and major axis corresponding to the hole diameter specified in this application. Each distributor device forming a pulp web can also contain two or more distributor housings with two or more separate inlets for each distributor housing.

The invention claimed is:

1. A method of distributing cellulose pulp, comprising:

providing a cellulose pulp having a consistency range of 2 to 14%;

providing a manifold housing in fluid communication with a transversely directed elongate distributor housing, the distributor housing having an elongate rotatable helical feed screw disposed therein, the distributor housing having a first hole, a second hole and a third hole defined therein, the first, second and third holes being distributed along a generatrix of the distributor housing;

feeding the cellulose pulp into an inlet of the manifold housing;

rotating the feed screw to convey the cellulose pulp in the transverse direction through the distributor housing;

the feed screw sweeping across the first, second and third holes in the distributor housing to urge the cellulose pulp through the first, second and third holes;

uniformly feeding the cellulose pulp through the first, second one third holes;

feeding the cellulose pulp through an inlet to dewatering drums;

running the cellulose pulp between the dewatering drums and a trough to form a pulp web;

dewatering the pulp web in a press nip formed between the dewatering drums; and collecting the dewatered pulp web by a pulp collecting screw.

2. The method according to claim 1 wherein the method further comprises placing the first, second and third holes at a lowest part of the distributor housing.

3. The method according to claim 1 wherein the method further comprises providing the feed screw with a screw core that has a screw thread, the screw core has a continuously increasing diameter for maintaining a substantially constant flow of the cellulose pulp through the holes and for compensating for pressure losses resulting from the cellulose pulp being fed through the first, second and third holes.

4. The method according to claim 3 wherein the method further comprises continuously decreasing a pitch of the screw thread.

5. The method according to claim 1 wherein the method further comprises providing the distributor housing with an inlet, arranging the inlet at a middle of the distributor housing.

6. The method according to claim 1 wherein the method further comprises providing the distributor housing with an end having a counter thread and the counter thread creating a counter pumping effect at the end of the distributor housing.

7. The method according to claim 1 wherein the method further comprises the holes preventing the cellulose pulp from falling free down towards the pulp web.

8. The method according to claim 1 wherein the method further comprises the holes forming a pressure crop, the pressure drop distributing the cellulose pulp across the entire distributor housing before feeding out the cellulose pulp from the distributor housing.

9. The method according to claim 1 wherein the method further comprises the feed screw sweeping a crest thereof across the holes to maintain a continuous exposure of the holes.

* * * * *